US005544439A

United States Patent [19]

Grember et al.

[11] Patent Number: 5,544,439

[45] Date of Patent: Aug. 13, 1996

[54] DEVICE FOR FIRING A FIREARM USING AN INFRARED DETECTOR

[75] Inventors: Eric Grember; Claude Boutet, both of Bourges, France

[73] Assignee: Giat Industries, Versailles Cedex, France

[21] Appl. No.: 408,117

[22] Filed: Mar. 21, 1995

Related U.S. Application Data

[63] Continuation of Ser. No. 118,676, Sep. 10, 1993, abandoned.

[30] Foreign Application Priority Data

Sep. 10, 1992 [FR] France ..... 92 10812

[51] Int. Cl.[6] ..... F41A 19/59

[52] U.S. Cl. ..... 42/100; 89/41.03; 89/41.06; 89/41.17

[58] Field of Search ..... 42/84, 100, 103; 89/28.2, 41.03, 41.06, 41.07, 41.08, 41.17; 102/427

[56] References Cited

U.S. PATENT DOCUMENTS

| | | | |
|---|---|---|---|
| 2,597,565 | 5/1952 | Chandler et al. | 42/103 |
| 3,509,791 | 5/1970 | Pechamat | 89/41.06 |
| 3,614,439 | 10/1971 | Beelik et al. | 250/332 |
| 3,659,494 | 5/1972 | Philbrick et al. | 89/41.03 |
| 4,332,098 | 6/1982 | Estenevy | 42/84 |
| 4,370,914 | 2/1983 | Voles | 89/41.03 |
| 4,718,187 | 1/1988 | Blake | 42/84 |
| 4,852,457 | 8/1989 | Schlegel et al. | 42/84 |

FOREIGN PATENT DOCUMENTS

| | | | |
|---|---|---|---|
| 444844 | 6/1972 | Austria . | |
| 764537 | 5/1934 | France | 89/41.06 |
| 2419757 | 11/1975 | Germany | 89/41.06 |
| 2939239 | 4/1981 | Germany . | |
| 3643197 | 6/1988 | Germany | 89/41.06 |
| 375258 | 1/1940 | Italy | 89/28.2 |
| 37410 | 11/1912 | Sweden | 42/84 |
| 564158 | 9/1944 | United Kingdom | 89/41.06 |
| 2103341 | 2/1983 | United Kingdom | 89/41.08 |
| 2108244 | 5/1983 | United Kingdom | 102/427 |

OTHER PUBLICATIONS

Anderson, Gary L., Marksmanship, "9. Holding and Firing", 1972, pp. 64–66.

Jane's Infantry Weapons 1984–85, 1984, pp. 752–761, 778–783.

*Primary Examiner*—Stephen C. Bentley

*Attorney, Agent, or Firm*—Oliff & Berridge

[57] ABSTRACT

A device for firing a small or medium caliber firearm includes a rangefinder, an infrared detector supplying an electrical signal, an electronic triggering assembly for controlling firing, and an electrical energy source. The triggering assembly is associated with percussion firing, using an electromagnet connected to the firing pin of the weapon. Firing of the firearm is activated by the detection of the heat signature of a target with the infrared detector.

13 Claims, 4 Drawing Sheets

DEVICE FOR FIRING A FIREARM USING AN INFRARED DETECTOR

This is a continuation of application Ser. No. 08/118,676 filed Sep. 10, 1993, now abandoned.

BACKGROUND OF THE INVENTION

The present invention relates to a device for firing a firearm, and more particularly, to a device that fires a firearm upon detection of the heat signature of a target using an infrared detector.

It is well known to equip a weapon with an aiming device composed of a rear sight and a front sight, with the line of sight thus defined being aligned with the target. The probability of hitting the target is known to be relatively low because it is linked to several factors: the accuracy of the weapon, the ambient conditions, and the sight. The first two factors have relatively minor effects because well-known classic solutions can be implemented to improve the probability of hitting the target. The third factor, however, has never been taken into account because of its link to the human factor, although its effects are critical. The average infantryman or shooter in combat is often subject to trembling, which prevents the shooter from aiming his weapon at the target in a stable fashion. As a result, in actual combat, the average number of bullets fired to hit a target is relatively high. This disadvantage is further increased by the aim at the target being deflected from kickback when the shooter pulls the trigger to fire.

Thus, there may be differences in accuracy on the order of 5 meters for a shot at 300 meters. It is therefore necessary to repeat the shot, increasing the risk of the shooter being spotted.

In addition, further inaccuracies occur when the target is moving and the determination of the point being aimed at as well as the moment of firing are random in view of the travel time of the bullet.

SUMMARY OF THE INVENTION

A goal of the invention is to increase the probability of hitting a target by eliminating the human factor element when starting to fire, with the shot being triggered by the heat signature of the target.

To this end, the invention proposes a device for firing a small or medium caliber firearm, including:

- an observation sight,
- an electric energy source,
- an infrared detector coupled to the electric energy source delivering an electrical signal,
- an electronic system for processing the signal supplied by the detector, and
- an electronic triggering device for controlling firing of the firearm in accordance with the electrical signal.

The electronic triggering device can be associated with firing either by percussion, using an electromagnet connected to the firing pin of the weapon, or by electricity, directly controlling the firing of the ammunition.

An important advantage of the invention lies in the fact that the device eliminates the human factor when firing because the shot is triggered by the heat signature of the target. The infrared characteristics of the targets are therefore advantageously utilized. The infantryman is a relatively warm target by comparison with the environment, and detection of the target automatically triggers the shot.

Another advantage lies in the fact that normal firing of the weapon is not prevented by the device according to the invention.

BRIEF DESCRIPTION OF THE DRAWINGS

Other characteristics and advantages of the invention will be apparent from the description of an embodiment provided as an example with reference to the attached drawings.

DETAILED DESCRIPTION OF PREFERRED EMBODIMENTS

According to a preferred embodiment, the firing device comprises a control bar driven translationally by the trigger of the weapon and by the electromagnet in the case of firing by percussion.

According to another embodiment, the firing pin of the weapon is released by the control bar.

The infrared detector is preferably sensitive in the 8–12 micron range and is located at the focus of the observation sight.

According to another embodiment, the electronic processing assembly includes an amplifier and a filter followed by a comparator, wherein the electrical signal is representative of a predetermined type of target.

According to another embodiment, the observation sight is located below the weapon and ahead of its grip.

According to yet another embodiment, the electronic processing assembly, the electronic triggering device, and the electrical energy source are disposed in the observation sight opposite the entry window of the optical sight.

According to still another embodiment, the trigger is provided with two notches, the first notch allowing the electronic processing assembly to be activated, and the second notch permitting direct control of the firing of the weapon.

Figure 1:
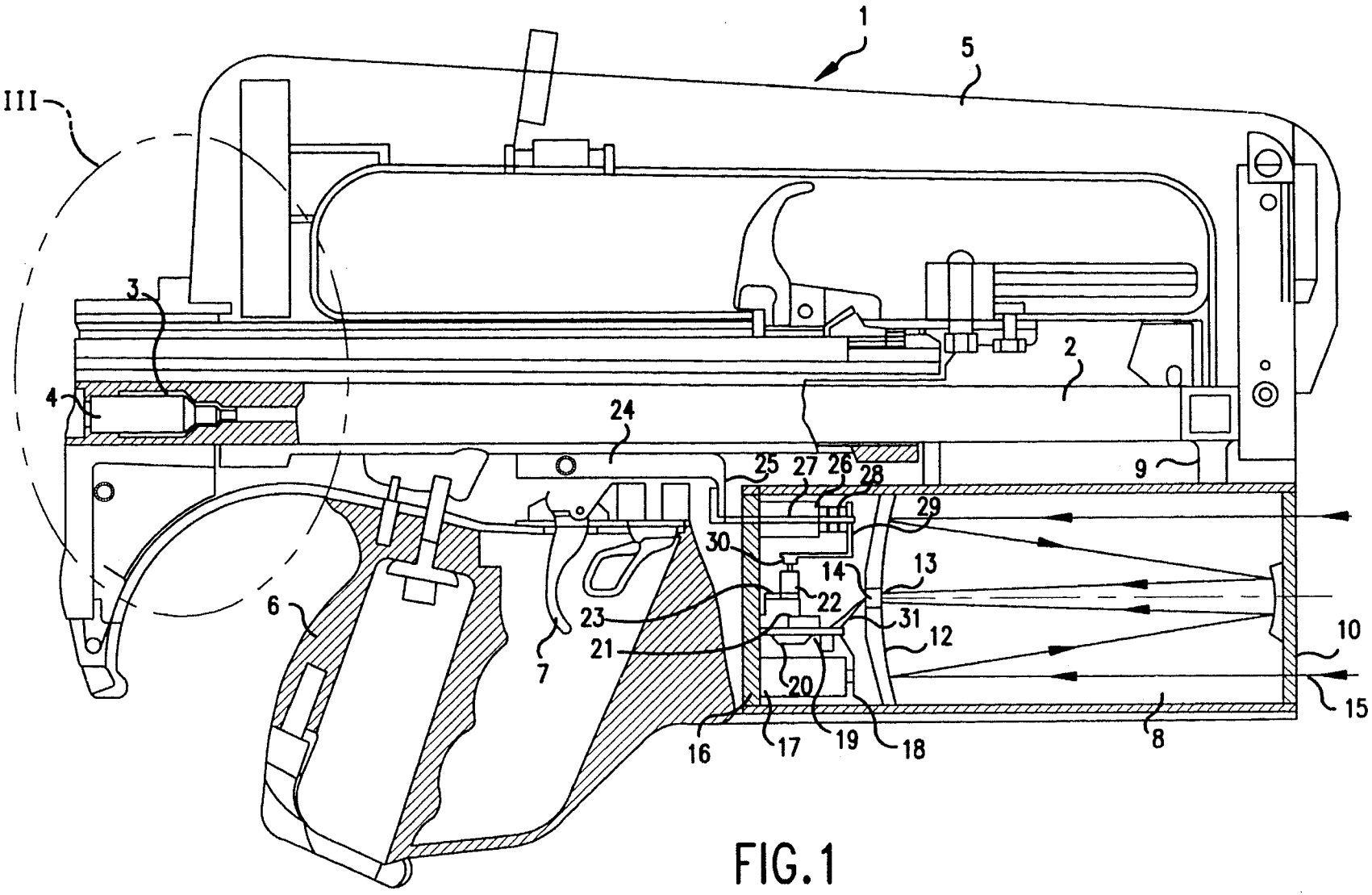
FIG. 1 shows a lengthwise section of a weapon equipped with the device according to the invention.

Weapon 1 shown in FIG. 1 comprises a barrel 2 extended by a chamber 3 into which ammunition 4 is introduced either automatically or manually by means not shown, a sight support 5 mounted on top of the weapon, and a guard 6 protecting trigger 7.

According to the invention, a observation sight 8 is provided, for example of the Cassegrain type, having a field from 30 cm to 300 m. Observation sight 8 is mounted on the weapon, for example, by soldered lugs 9 or by clamps. The arrangement is such that the axis of the barrel or firing axis, the axis of the sight, and the optical axis of the observation sight are aligned. Observation sight 8 comprises an entry window 10 with a concave mirror 11. This window located at the entry has no optical function and serves to protect the internal elements and the mount for mirror 11. A second concave mirror 12 is mounted inside the body of the observation sight and has a diameter essentially equivalent to the inside diameter of the body. Mirror 12 is provided at its center with an opening 13 receiving an infrared detector 14 sensitive to the 8–12 micron range. Thus, light rays 15 penetrate into the observation sight, are reflected once at concave mirror 12, then at concave mirror 11, which concentrates them on detector 14 located at the focus of mirror 12. The wall of base 16 of the observation sight serves to support other means of the device according to the invention. The electrical energy supply means are constituted by at least one battery 17 whose base abuts wall 16 and which is held in place by a tongue 18 connected to a plate 19, integral with wall 16. An electronic assembly 20 and an electronic firing means 21 are mounted on plate 19. These elements are shown schematically as blocks.

The signal delivered by firing means 21 is sent to a switch 22 integral with a support 23 mounted on wall 16.

Figure 3:
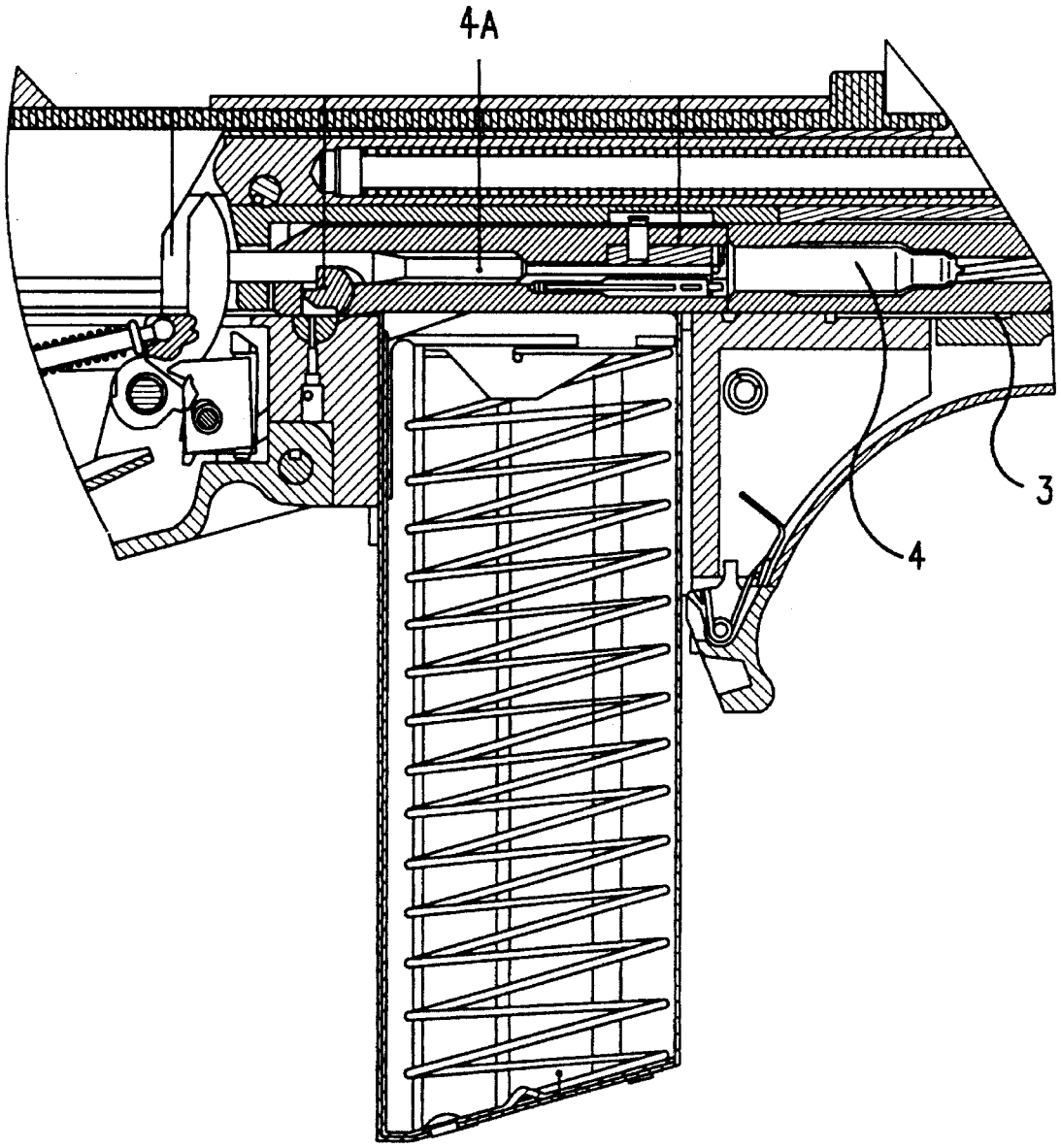
FIG. 3 shows a closeup view of the firing pin according to the invention in area III of FIG. 1.

In the embodiment described, firing is accomplished by percussion. Trigger 7 is therefore connected to a control bar 24, which at one end frees, in a known manner shown in FIG. 3, the firing pin 4A of the weapon. According to the invention, bar 24 is extended at its end by a side wall 25 designed to cooperate with an electromagnet 26, likewise mounted on wall 16. Control rod 27 of the electromagnet, subject to the action of spring 28, thus abuts side wall 25 at one end and is integral at its other end with a rod 29 bearing at its free end a cam 30 abutting switch 22.

Figure 2:
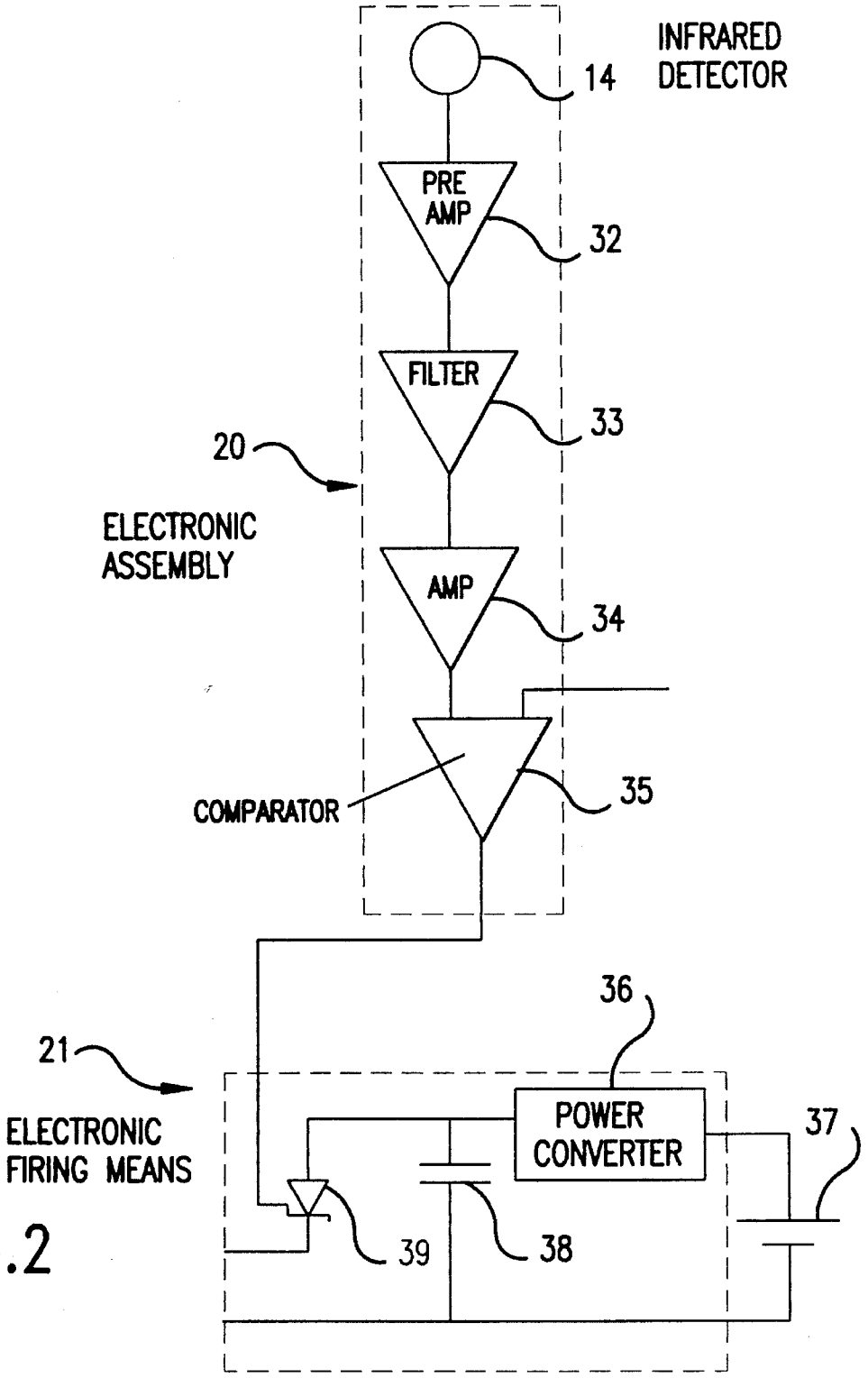
FIG. 2 shows an embodiment of the electrical and electronic means with which the device according to the invention is equipped.

FIG. 2 shows electronic assembly 20, essentially comprising detector 14, which generates a detection signal that is amplified by a preamplifier 32 and sent to a filter 33 for filtering from the signal detected by detector 14 any undesirable signal characteristics. The filtered signal is subsequently amplified by amplifier 34 and compared to a reference by a comparator 35 that delivers the firing control signal to the electronic firing means 21.

The electronic firing means 21 comprises a converter 36 to raise the direct current delivered by battery 37, a capacitor 38 to power converter 36, and a triggering thyristor 39 for controlling switch 22 to fire the firearm.

Operation is as follows: the shooter sights by scanning the target laterally and pulls the trigger as far as the first notch. The system is then activated and the passage of the target through the field of observation sight 8 induces an electrical signal in detector 14. The signal is sent by conductors 31 to electronic assembly 20, which, after processing, sends an order to electromagnet 26, which activates bar 24 by means of its rod 27. The bar then triggers the shot by releasing the firing pin.

Of course, the weapon can be fired either automatically or semiautomatically, since these functions are not suppressed. In addition, the weapon can be used for direct firing without waiting for the command by detection; it is merely necessary to pull the trigger to the second notch. A second switch (not shown) can be provided to disable the device according to the invention.

It will be noted that it is the difference in heat signatures between the background and the target that triggers the system. A difference of 2 or 3 degrees is sufficient to trigger the shot.

Figure 4:
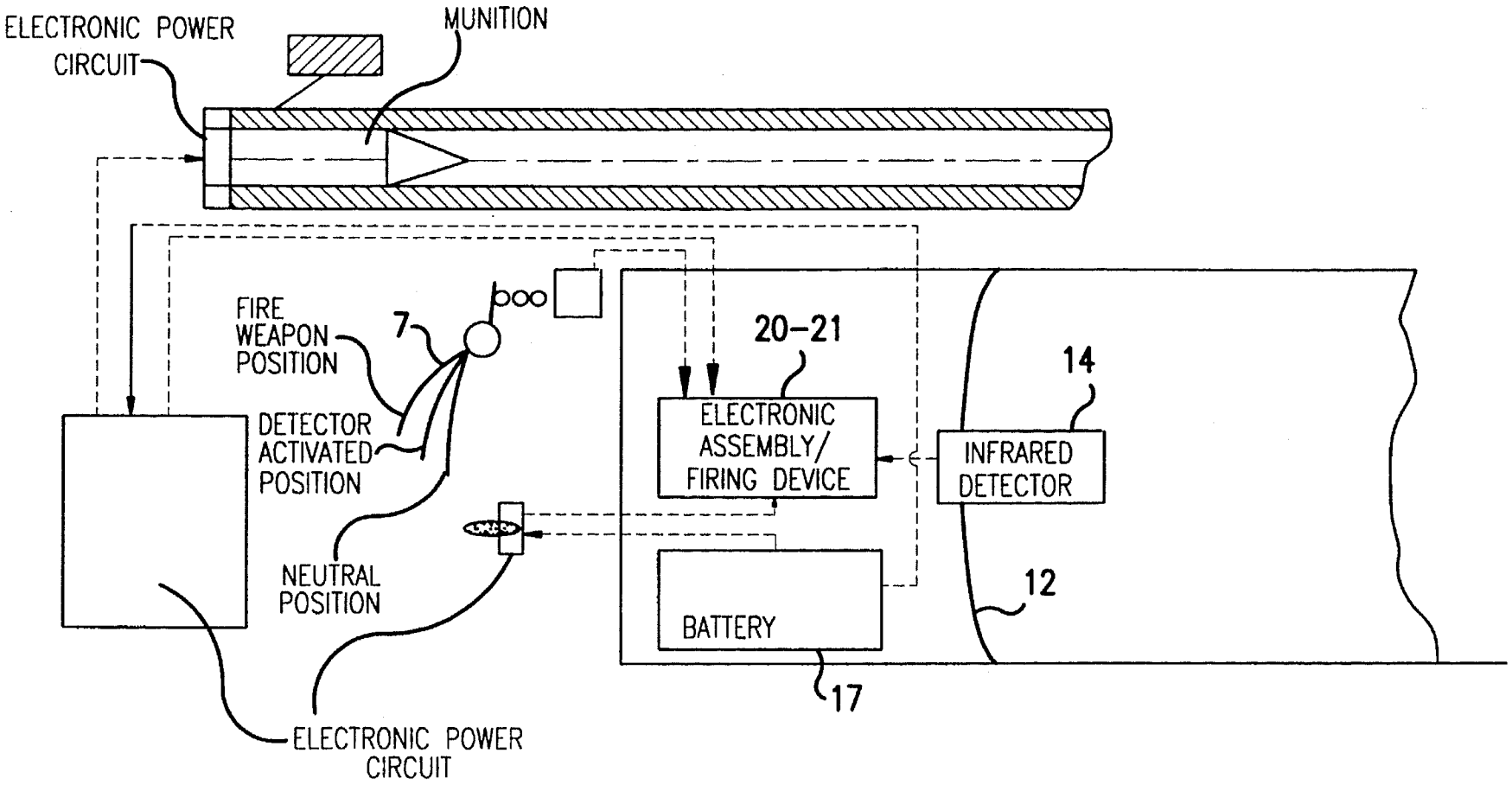
FIG. 4 is a schematic illustration of an alternate embodiment of the invention.

A variation on the invention can easily be adopted if an electrically fired weapon is involved. In this case, referring to FIG. 4 electromagnet 26 and switch 22 are eliminated and replaced by an electronic power circuit connected to electronic means 21, which sends the signal to fire directly to the electrical firing system of the weapon itself.

Another variation can be envisaged for night combat for example. It would then be useful, since the target is invisible, for the shooter to hold fire but to be alerted by visible or audible means of the presence of a warm target. It will suffice to add to the device a switch to disconnect the power circuit and a piezoelectric transducer for example that will produce an audible signal.

While the invention has been described with reference to the structure disclosed, it is not confined to the details set forth, but is intended to cover such modifications or changes as may come within the scope of the following claims.

What is claimed is:

1. A device for firing a small or medium caliber hand-held firearm, having a firing pin and a trigger that actuates the firing pin, the device comprising:

an electric energy source;

an observation sight with an infrared detector coupled to the electric energy source for detecting a target heat signature and supplying a target electrical signal corresponding to the target heat signature, the infrared detector being disposed at a focus of the observation sight;

an electronic processing assembly coupled to the electric energy source for processing the target electrical signal supplied by the infrared detector; and an electronic trigger assembly that fires the firearm upon detection of the target heat signature in response to the target electrical signal, the electronic trigger assembly including an electromagnet activated in accordance with the target electrical signal to cause percussion firing and a control bar coupled to the electromagnet and actuated to move translationally under action of the electromagnet and said trigger to engage said firing pin.

2. A device according to claim 1, wherein the firing pin is released by the control bar.

3. A device according to claim 1, wherein said infrared detector is sensitive in an 8–12 micron range observation sight.

4. A device according to claim 1, wherein said electronic processing assembly comprises an amplifier in electrical communication with a filter that is in turn in electrical communication with a comparator, wherein the target electrical signal is representative of a predetermined type of target.

5. A device according to claim 3, wherein the observation sight is mounted below the firearm and ahead of its grip.

6. A device according to claim 3, wherein the electronic processing assembly, electronic trigger assembly, and electrical energy source are disposed in the infrared detector opposite an entry window of said infrared detector.

7. A device according to claim 4, wherein said electronic trigger assembly comprises a first notch and a second notch, the first notch allowing activation of said electronic processing assembly, and the second notch permitting direct manual control of the firing of the firearm.

8. A hand-held firearm comprising a target heat signature detector for detecting a heat signature of a target and a firing mechanism for firing the firearm, wherein upon detection of the heat signature the target heat signature detector generates a signal that actuates the firing mechanism to fire the firearm toward the target, the target heat signature detector having an infrared detector, at least one entry window, a first concave mirror and a second concave mirror, wherein light rays enter the target heat signature detector through the entry opening and are reflected by the first concave mirror and the second concave mirror to the infrared detector.

9. A firearm according to claim 8, further comprising means for firing said firearm regardless of said detector.

10. A firearm according to claim 8, further comprising a trigger movable between a neutral position, a first notch and a second notch, wherein when said trigger is pulled to said first notch, said detector is activated, and when said trigger is pulled to said second notch, said firearm is fired.

11. A firearm according to claim 8, wherein said firing mechanism comprises a control bar fixed at one end to said trigger and at another end to an electromagnet via a rod, said firing mechanism further comprising a switch activated in accordance with said signal, wherein when said detector detects said heat signature of said target, said switch activates said electromagnet, thereby activating said control bar and firing said firearm.

12. A firearm according to claim 8, wherein said infrared detector is sensitive in an 8–12 micron range.

13. A firearm according to claim 8, wherein said signal selectively actuates said firing mechanism depending on whether said firearm is in a firing mode or a detecting mode.

* * * * *